United States Patent [19]

Corniani

[11] Patent Number: 4,982,554

[45] Date of Patent: Jan. 8, 1991

[54] APPARATUS FOR APPLYING CLOSURES TO CONTAINERS

[75] Inventor: Carlo Corniani, Marmirolo, Italy

[73] Assignee: Azionaria Costruzioni Macchine Automatiche A.C.M.A. S.p.A., Bologna, Italy

[21] Appl. No.: 423,287

[22] Filed: Oct. 18, 1989

[30] Foreign Application Priority Data

Oct. 31, 1988 [IT] Italy ..... 3645 A/88

[51] Int. Cl.[5] ..... B65B 7/28; B67B 3/20

[52] U.S. Cl. ..... 53/290; 53/308; 53/317; 53/331.5

[58] Field of Search ..... 53/128, 290, 308, 317, 53/319, 331.5, 367

[56] References Cited

U.S. PATENT DOCUMENTS

| | | | |
|---|---|---|---|
| 2,810,249 | 10/1957 | Wysocki | 53/317 |
| 3,141,278 | 7/1964 | Wysocki | 53/319 |
| 3,212,173 | 10/1965 | Wonneman | 53/319 |
| 3,212,175 | 10/1965 | Wonneman | 53/319 |
| 3,242,632 | 3/1966 | Dimond | 53/317 |
| 3,299,495 | 1/1967 | Wysocki | 53/319 |

FOREIGN PATENT DOCUMENTS 1271271 4/1972 United Kingdom .

*Primary Examiner*—Robert L. Spruill
*Assistant Examiner*—Linda B. Johnson
*Attorney, Agent, or Firm*—Guido Modiano; Albert Josif

[57] ABSTRACT

Apparatus for applying closures to containers, comprising a first rotating conveyor adapted to move containers to be closed to a second rotating conveyor, and a third rotating conveyor adapted to remove the closed containers from the second conveyor. The second conveyor comprises a rotating supporting element adapted to receive and transfer containers in succession, and grip elements which overlie the supporting element and are adapted to receive in succession closures which are downwardly provided with a tube for extracting the liquid contained in the containers and to screw the closures on the containers after the tubes have entered the containers. The apparatus furthermore comprises grip elements which are adapted to grip the upper portion of the tubes before they are inserted in the containers and to slide toward the lower end of the tubes so as to straighten the tubes and allow them to correctly enter the containers.

9 Claims, 3 Drawing Sheets

APPARATUS FOR APPLYING CLOSURES TO CONTAINERS

BACKGROUND OF THE INVENTION

The present invention relates to an apparatus for applying closures to containers.

In particular, the present invention relates to closures having a dispensing device and being downwardly provided with a tube for extracting the liquid contained in the containers.

In the following description, the containers at issue will be termed bottles without thereby causing the invention to lose generality.

According to the prior art, the actual operation of applying a closure of the above described kind to a bottle, which is often performed by screwing, must be preceded by the insertion of said tube through the neck of said bottle. This insertion is difficult, since the tubes applied to the closures are usually made of thin flexible plastic material and are often not rectilinear but curved to a greater or smaller extent. This fact does not allow to insert said tubes in the bottles by simply superimposing them on said bottles and then moving them axially downward, but requires particular measures.

In order to allow the insertion of the tubes inside the necks of the bottles, it has been proposed to bring a rectilinear guiding element transversely near to said tubes before said insertion is performed, said rectilinear element being essentially constituted by a tubular element which is laterally provided with a slot for the passage of a tube. Said guiding element is brought adjacent to each tube while said tube is located above the bottle into which the tube is to be inserted, so as to accommodate said tube inside said guiding element through said slot and so as to deform said tube until it becomes substantially rectilinear. The guiding element and the tube contained therein are then lowered by a small amount, and as soon as the free end of the tube enters the neck of the bottle the guiding element moves away and the insertion of the tube in the bottle can be completed simply by lowering it.

Such a solution is however not always sufficient to make each tube substantially rectilinear at the beginning of its insertion into a bottle, since if said tube is curved along a direction which is opposite to the direction of entry into said slot the insertion into said guiding element does not influence in any way the curvature of the tube, which is thus unable to correctly enter the neck of the respective bottle.

SUMMARY OF THE INVENTION

The aim of the present invention is to provide an apparatus for applying closures to containers, for example bottles, said closures being of the type downwardly provided with a tube for extracting the liquid contained in said containers, said apparatus solving the disadvantages described with reference to the prior art, in other words allowing said tubes to be inserted in said containers simply by moving them axially.

This aim is attained according to the present invention by an apparatus for applying closures to containers, as defined in claim 1.

BRIEF DESCRIPTION OF THE DRAWINGS

The present invention is now described merely by way of non-limitative example with reference to the accompanying drawings, wherein.

DESCRIPTION OF THE PREFERRED EMBODIMENTS

Figure 1:
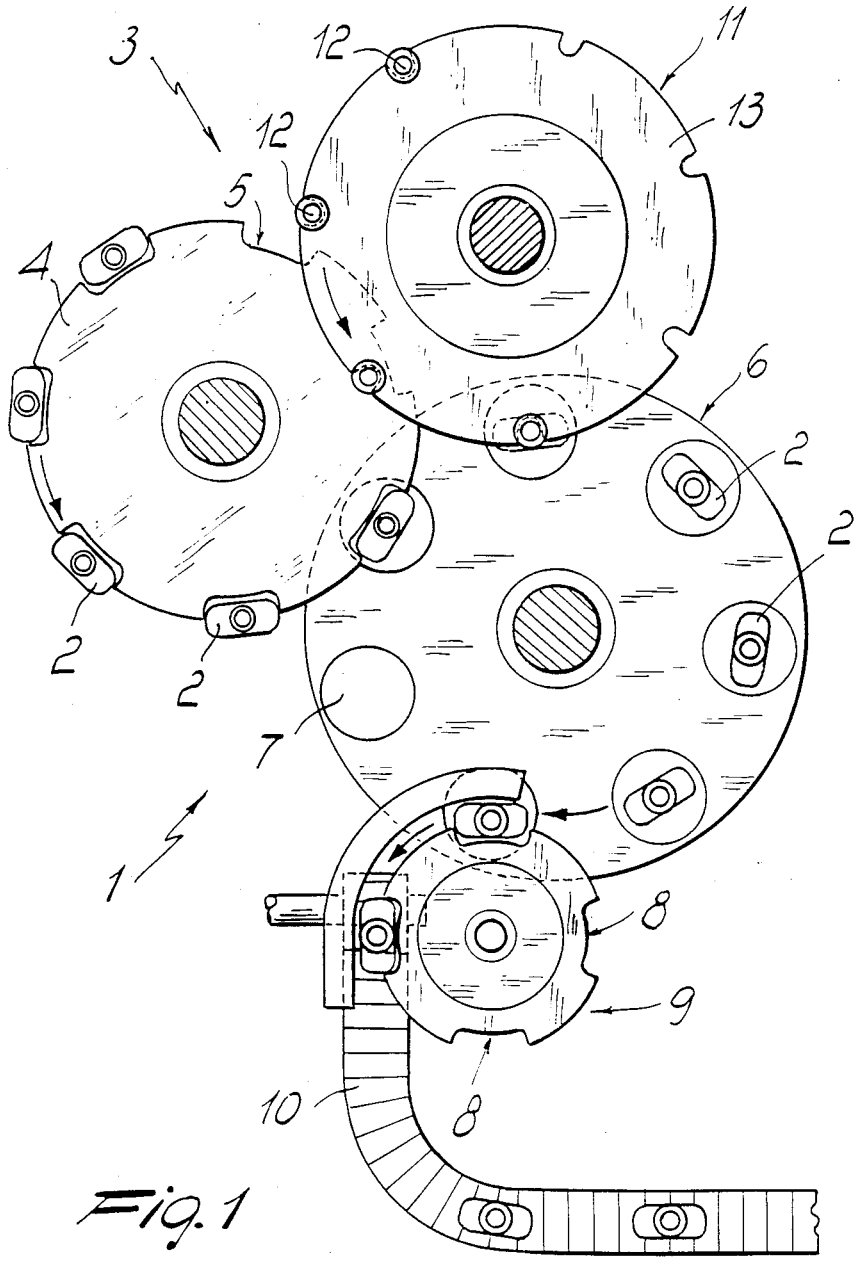
FIG. 1 is a schematic plan view, with some parts removed for the sake of greater clarity, of a portion of a bottle filling machine which includes an apparatus provided according to the teachings of the present invention.

With reference to FIG. 1, the reference numeral 1 generally indicates an apparatus for transferring products 2, constituted for example by bottles, which belongs to a filling machine which is illustrated only partially and is generally indicated by the reference numeral 3.

The transfer apparatus 1 comprises a container rotating conveyor transfer apparatus comprising a rotating conveyor 4 with a vertical axis, peripherally provided with mutually equally spaced containment recesses 5 and adapted to pass bottles 2 in succession to a rotating conveyor 6 which is also termed hereafter closure unit and is rotatable about a vertical axis; said closure unit is provided with a plurality of circular peripheral supporting plates 7 which are equally angularly spaced with respect to one another; the conveyor 6 is in turn capable of passing the bottles 2 toward the peripheral recesses 8 of a finished product rotating conveyor transfer apparatus comprising rotating conveyor 9 which is rotatable about a vertical axis and is adapted to pass said bottles 2 to a transfer line defined by a transfer line chain conveyor means comprising horizontal chain conveyor 10. A closure rotating conveyor transfer apparatus comprising apparatus 11 for transferring closures 12 adapted to close the bottles 2, constituted by a known rotating conveyor 13 which is not described further, is arranged proximate to the rotating conveyor 6, to pass respective closures 12 in succession to closure grip elements 14 of said conveyor 6 which are described hereafter. Said closures 12, as visible in FIGS. 2 to 6, are downwardly provided with respective tubes 15 adapted to convey the liquid contained in the bottles 2 toward a dispenser device (not illustrated) provided on the upper portion of each closure 12.

Figure 2:
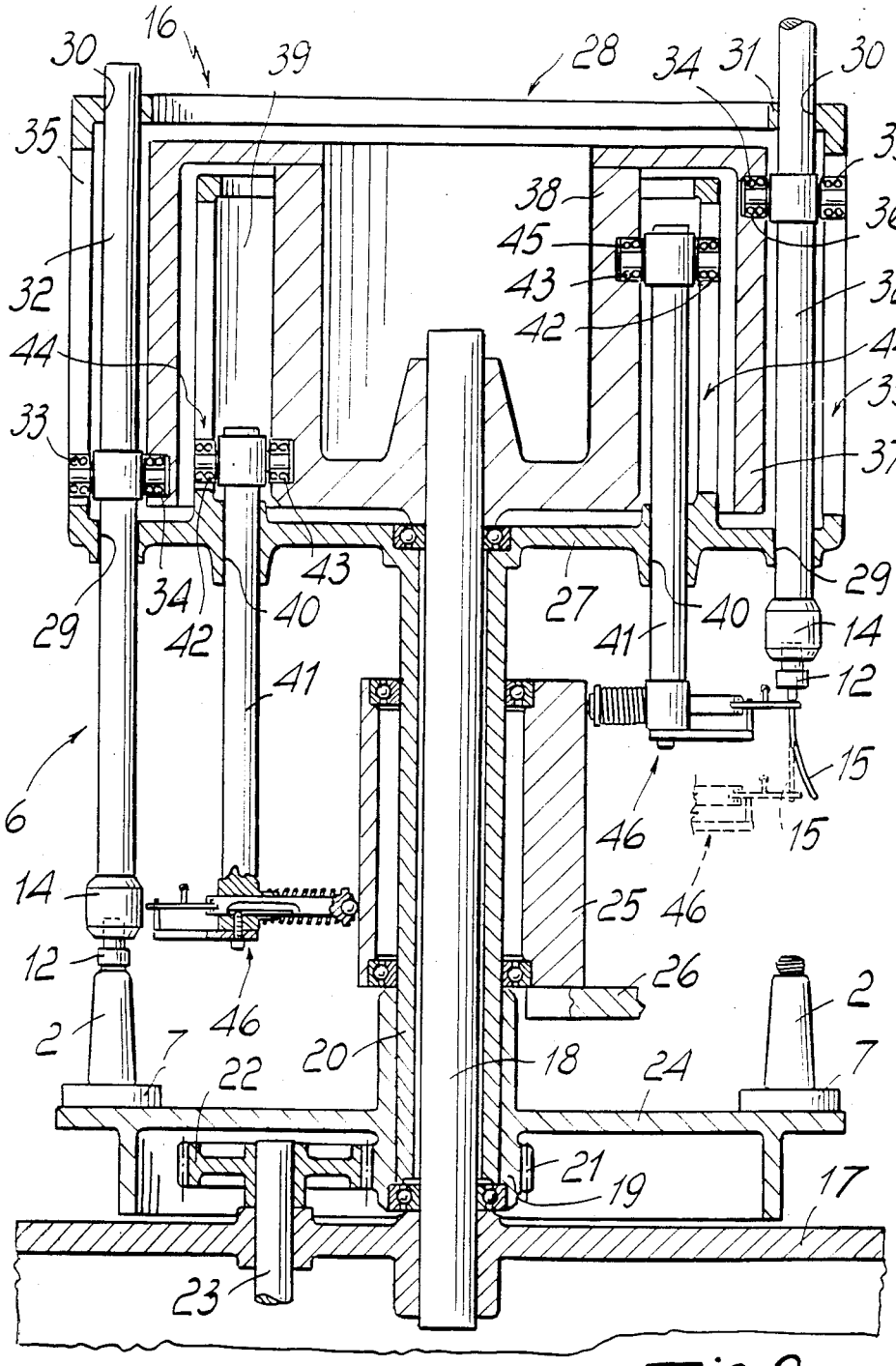
FIG. 2 is a sectional elevation view of the apparatus according to the present invention.
Figure 3:
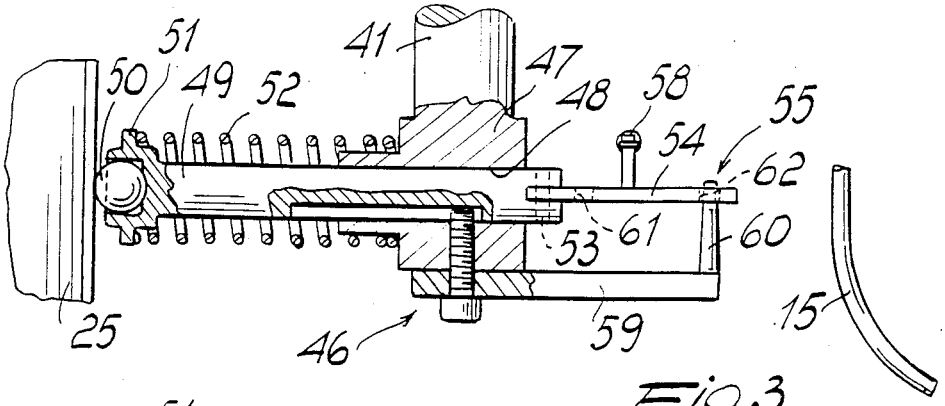
FIG. 3 is an elevation view of a detail of the apparatus of FIG. 2 in a first operating condition.
Figure 4:
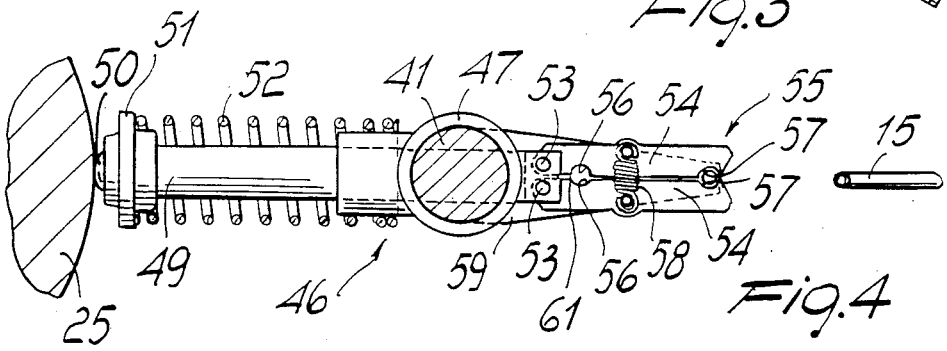
FIG. 4 is a plan view of the detail of FIG. 3.
Figure 5:
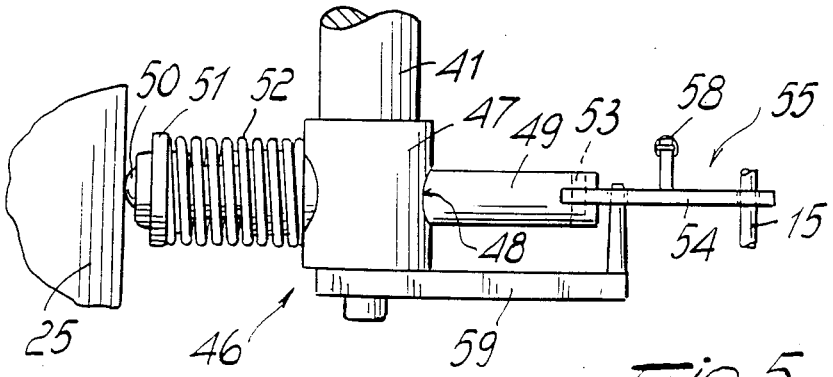
FIG. 5 is an elevation view of the detail of FIG. 3 in a second operating condition.
Figure 6:
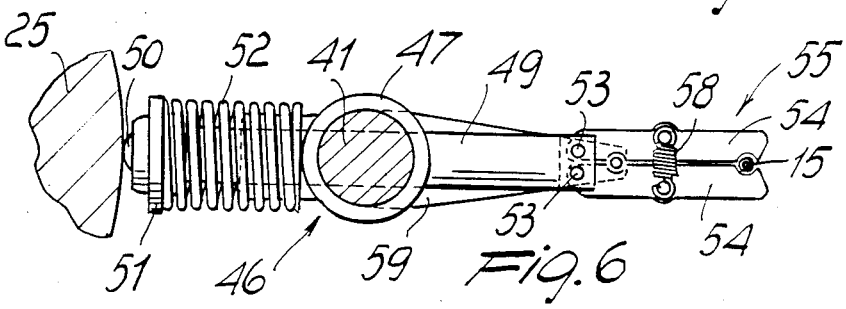
FIG. 6 is a plan view of the detail of FIG. 5.

As visible in FIG. 2, the rotating conveyor 6 essentially comprises a drum 16 with a vertical axis, supported by a horizontal wall 17 which is a part of the base of the machine 3.

Said drum 16 comprises a vertical shaft 18 which is rigidly connected to said wall 17 and rotatably supports a support disk sleeve comprising sleeve 19 which is coaxial thereto and overlies the wall 17. Said sleeve 19 contains a sleeve 20 which is rigidly associated therewith at its lower portion and is also rotatable with respect to the shaft 18; said sleeve 20 protrudes from the upper end of the sleeve 19 and extends toward the upper end of said shaft 18. A gearwheel 21 is keyed on the lower end of the sleeve 19 and engages a gearwheel 22 which is keyed on the upper end of a shaft 23 which traverses the wall 17 and is connected, in a manner which is not illustrated, to a source of rotary motion which is also not illustrated.

A container conveyor support means comprising a horizontal supporting element or disk 24 is connected to a middle portion of the sleeve 19 and its upper face supports the circular plates 7, which are seven in FIG. 1, are uniformly angularly spaced and are adapted to receive and support respective bottles 2 which arrive in succession from the rotating conveyor 4.

Directly above the sleeve 19, the sleeve 20 rotatably supports an actuation cam means comprising a cylinder cam 25 which is connected, in a manner which is not illustrated, to the base of the machine 3 by means of a bracket 26 and is thus stationary.

The upper end of the sleeve 20 extends in a disk 27 defining the lower side 27 of a substantially cylindrical support means comprising box-like body 28, said disk being provided with a plurality of circular holes 29 which are coaxial to said plates 7. Vertical axially slidable shafts 32 extend through said 5 holes 29 and through a same number of holes 30 formed in the upper side 31 of the box-like body 28, and support, at their respective portion arranged inside said box-like body 28, two rollers 33 and 34 which are diametrically opposite with respect to the respective shaft 32. The roller 33 of each shaft 32 engages a respective vertical slot 35 provided in the cylindrical wall of said box-like body 28, and the roller 34 of each shaft 32 engages an actuator means comprising a cam-shaped groove 36 provided on the periphery of a cup-like body 37 which has a downwardly directed concavity and is contained within the box-like body 28; said cup-like body 37 is rigidly associated with a cup-like body 38 which has an upwardly directed concavity and has its lower portion rigidly associated with the upper portion of the shaft 18. Therefore, it is seen that the shaft 18, the wall 17, and the two cup-like bodies 37 and 38 combine to form a stationary support structure which rotatably supports the rotating conveyor closure unit 6. The extension of the shaft 18 advantageously defines the rotation axis about which the unit 6 rotates.

The lower end of a hollow cylindrical body 39 is rigidly associated with the upper surface of the disk 27, at a region of said disk 27 which is comprised between the cup-like body 38 and the cylindrical wall of the box-like body 28, said body 39 extending vertically nearly up to the base of the cup-like body 37.

The disk 27 is provided, at a region thereof comprised between the cup like body 38 and the cylindrical wall of the cup-like body 37, with a plurality of holes 40, equal in number to the shafts 32 and radially aligned therewith. Each of said holes 40 is slidably traversed by a respective shaft 41 which supports, at its upper end contained within the hollow cylindrical body 28, two rollers 42 and 43 which are diametrically opposite with respect to said shaft 41. The roller 42 of each shaft 41 engages a respective vertical slot 44 provided in the hollow cylindrical body 39, while the roller 43 of each shaft 41 engages an actuator means comprising a cam-shaped groove 45 provided on the periphery of the cup-like body 38.

Outside the box-like body 28, the lower free end of each shaft 32 supports one of said closure grip elements 14, which are of a known type and are therefore not described in detail; said closure grip elements are capable of receiving a closure 12 from the rotating conveyor 13 and of screwing said closure on a respective bottle 2 as described hereafter.

Outside the box-like body 28, the lower free end of each shaft 41 supports a tube grip means 46 for the tubes 15 which are rigidly associated with the closures 12; said tube grip means is illustrated in detail in various operating conditions in FIGS. 3 to 6.

As visible in said figures, each tube grip means 46 comprises a cylindrical element 47 with a vertical axis which is coaxial to the respective shaft 41 and is rigidly associated with the lower end thereof. The cylindrical element 47 is traversed by a hole 48 which is horizontal and radial with respect to the shaft 41 and slidably accommodates a shaft 49; said shaft 49 has one end held in contact with said cylinder cam 25 by cam follower actuation means comprising a helical spring 52 of a rotary coupling including a ball 50 accommodated within an adapted seat defined on said end. Proximate to said end, the shaft 49 has an abutment ring 51 for one end of the helical spring 52 which is wrapped around the shaft 49 and rests with its other end against the surface of the cylindrical element 47.

The other end of the shaft 49 rotatably supports, by means of two pivots 53, a pair of tube grip elements 54 of a clamp element 55. Each tube grip element 54 comprises an elongated horizontal plate, pivoted with one of its ends to the respective pivot 53 and provided, respectively in its portions which are proximate to the pivot 53 and proximate to its free end, with two substantially semi-circular recesses 56 and 57 which are directed toward the axis of the respective shaft 49. The middle regions of the two plates 54 are mutually connected by a helical spring 58 which operates in traction and keeps said plates 54 normally adjacent to one another.

An end of a horizontal plate 59 is fixed to the lower base of the cylindrical element 47; said plate has its free end arranged below the clamp element 55. Said free end is connected to the lower end of a spread element comprising a vertical pin 60 which is capable of entering, subsequently to axial movements of the shaft 49 through the hole 48, one or the other of the substantially circular openings 61 and 62 defined respectively by the two facing recesses 56 and by the two facing recesses 57 of the pair of plates 54 of the clamp element 55.

In use, the rotating conveyor 4 feeds the bottles 2 in succession above the plates 7 of the conveyor 6, while the apparatus 11 passes closures 12 downwardly provided with respective tubes 15 to the closure grip elements 14 in a known manner; while they receive the closures 12, said closure grip elements are kept in their maximally raised condition by the shafts 32 due to the action of the cam groove 36 on the rollers 34. When a closure 12 arrives at a 5 closure grip element 14, the respective clamp element 55 occupies its raised position by virtue of the action of the cam groove 45 on the rollers 43, and remains at the maximum possible distance from the tube 15 of said closure 12 under the action of the cylinder cam 25. In this condition of the clamp element 55, the bar 59 keeps the pin 60 within the opening 62 (see FIGS. 3 and 4).

As the rotation of the conveyor 6 continues, said clamp element 55 is moved by the cylinder cam 25 to the position shown in the right portion of FIG. 2. During this movement of the clamp element 55, the pin 60 protrudes from the opening 62 and mutually spaces the free ends of the tube grip elements 54. At the end of the stroke of the clamp element 55 toward the tube 15 which faces it, the tube grip elements 54 move to the position illustrated in FIGS. 5 and 6 and accommodate the upper portion of said tube 15 within the opening 62, while the pin 60 moves into the opening 61 to again allow the mutual approach of the free ends of the tube grip elements 54.

The groove 45 then causes the shaft 41 and thus the clamp element 55 to move downwardly with a vertical rectilinear motion and to reach a position (illustrated in broken lines in FIG. 2) in which the opening 62 embraces a lower portion of said tube 15. The shaft 32 which supports the closure 12 by means of the closure grip element 14 is then lowered by virtue of the action of the groove 36 on the respective roller 34, and the clamp element 55, after being further moved downwardly so as to cause a partial insertion of the tube 15 within the neck of the bottle 2, opens again, is moved away from said tube 15 by the cylinder cam 25, and is then returned to its maximally raised condition by the groove 45. The shaft 32 is then lowered further by the groove 36, until the tube 15 is inserted completely within the bottle 2. The closure 12 is then screwed onto the bottle 2 by means of the closure grip element 14 in a manner which is not illustrated since it is known. As an alternative, this screwing can be performed in a known manner by means of rotating elements (not illustrated) capable of acting on the lateral surface of the closures 12 and of rotating them about their respective axes.

The shaft 32 is then raised again under the action of the groove 36, and the closed bottle 2 is passed to the conveyor 9 and is then transferred to the chain conveyor 10.

From what has been described it is evident that the apparatus according to the present invention is capable of overcoming the disadvantage described with reference to the prior art. The clamp elements 55 in fact allow to reliably straighten all the tubes 15 before they are inserted in the bottles 2.

Numerous variations may naturally be performed to the described apparatus 1 without thereby abandoning the scope of the present invention.

In particular, the rotating conveyor 6 and its actuation kinematisms may be provided in any equivalent manner, and the clamp elements 55 may be different from those which have been described, so long as they are capable of gripping the upper portions of the tubes 15 and of sliding downward along them as described so as to straighten them before they are inserted in the bottles 2.

I claim:

1. An apparatus for applying closures to containers, the closures being of the type having a protruding tube being insertable into a respective container, the apparatus comprising support structure means defining an axis of rotation, rotating conveyor closure unit means, and drive means, said rotating conveyor closure unit means being rotatably supported by said support structure means and being driven about said axis of rotation by said drive means, said rotating conveyor closure unit means comprising container conveyor support means for receiving in succession and supporting thereon containers to be closed, closure grip means adapted for receiving in succession and gripping therein closures to be applied to containers, tube grip means adapted for slidably gripping and straightening protruding tubes of closures gripped by said closure grip means, first slidable shaft means being linearly slidable in a direction substantially parallel to said axis of rotation, first roller means, second slidable shaft means being linearly slidable in a direction substantially parallel to said axis of rotation, second roller means, and box-like body support means for slidably supporting said first slidable shaft means by means of said first roller means and for slidably supporting said second slidable shaft means by means of said second roller means, said closure grip means being rigidly associated with a free end of said first shaft means, said tube grip means being rigidly associated with a free end of said second shaft means, said container conveyor support means being mutually structurally arranged with said closure grip means and said tube grip means such that container supported by said container conveyor support means are interposed between said container conveyor support means and said tube grip means and said closure grip means, said apparatus further comprising first actuation cam means, second actuation cam means, and third actuation cam means, said third actuation cam means being stationary actuation cam means and being arranged laterally to said tube grip means associated with said second shaft means, said tube grip means comprising cam follower actuation means for actuating said tube grip means by means of said third actuation cam means, whereby when said rotating conveyor closure unit means rotates about said axis of rotation of said support structure means, said first roller means of said first slidable shaft means engages with said first actuation cam means to thereby linearly slide said first slidable shaft means parallel to said axis of rotation, said second roller means of said second slidable shaft means engages with said second actuation cam means to thereby linearly slide said second slidable shaft means parallel to said axis of rotation, and said cam follower actuation means engages with said third actuation cam means to thereby actuate said tube grip means to actively slidably grip and straighten protruding tubes of closures, said first actuation cam means, said second actuation cam means and said third actuation cam means being mutually functionally arranged so as to cause a correct successive insertion of protruding tubes of closures into containers.

2. Apparatus according to claim 1, wherein said support structure means comprises a vertical shaft extending along said axis of rotation, said apparatus further comprising a vertical sleeve being rotatably supported around said vertical shaft, said third actuation cam means comprising a cylinder cam being rotatably supported about said vertical sleeve and being rigidly associated with a support base means by means of bracket means.

3. Apparatus according to claim 2, wherein said tube grip means comprise a cylindrical element defining a vertical axis coaxial with said second slidable shaft means and being rigidly associated with a lower end of said second slidable shaft means, said cylindrical element having a horizontal through hole being perpendicular to said vertical axis and slidably supporting therein a shaft having a first protruding end extending towards said cylinder cam and a second protruding end extending radially, with respect to said axis of rotation, from said cylindrical element, said cam follower actuation means comprising a roller ball accommodated within an adapted seat defined on said first protruding end of said shaft and a helical spring being wrapped about said first protruding end, said roller ball being in rolling contact with said cylinder cam, an abutment ring being provided at an extremity of said first protruding end of said shaft, said helical spring being interposed between said abutment ring and said cylindrical element, a horizontal plate being rigidly fixed to a lower base of said cylindrical element and extending therefrom radially with respect to said axis of rotation, said horizontal plate defining a free end being provided with a spread element comprising a vertical pin being rigidly connected and extending upwardly from said free end of said horizontal plate, said second protruding end of said shaft rotatably supporting, by means of two pivots, a pair of tube grip elements of a clamp element, each one of said pair of tube grip elements comprising an elongated horizontal plate being pivoted with one end thereof, to one of said two pivots and defining at said one end a first semi-circular recess being directed toward an extension axis of said shaft and defining at another end thereof a second semi-circular recess being directed toward said extension axis of said shaft, a traction helical spring being mutually connected to middle portions of said each one of said pair of tube grip elements, a first circular opening being defined by each said first semi-circular recess and a second circular opening being defined by each said second semi-circular recess, said vertical pin spreading said clamp element and being capable of entering, subsequently to radial movements of said shaft, said first circular opening and said second circular opening, said second circular opening slidably grasping tubes of closures when said vertical pin is in said first circular opening.

4. Apparatus according to claim 1, wherein said support structure means comprises a horizontal wall, a vertical shaft, a first cup-like body, and a second cup-like body, said vertical shaft being rigidly associated at a lower end thereof with said horizontal wall, said first cup-like body being rigidly associated with said vertical shaft at an upper end thereof and defining an upwardly directed cavity, said second cup-like body being rigidly associated with an upper region of said first cup-like body and defining a downwardly directed cavity enveloping said first cup-like body, said horizontal wall being rigidly associated with a support base means of said apparatus.

5. Apparatus according to claim 4, wherein said apparatus further comprises a vertical sleeve being rotatably supported around said vertical shaft, said box-like body support means comprising a cylindrical body enveloping said second cup-like body and said first cup-like body, said cylindrical body defining a lower disk extending from an upper end of said vertical sleeve, said container conveyor support means comprising a support disk rigidly connected to a lower end of said vertical sleeve by means of a support disk sleeve, said container conveyor support means further comprising a plurality of support plates being arranged on said support disk for accommodating individual containers, said drive means comprising a support disk sleeve gearwheel rigidly associated with a lower end of said support disk sleeve, a driven gearwheel meshing with said support disk sleeve gearwheel, a driven shaft rigidly keyed with said driven gearwheel and downwardly traversing through said horizontal wall, and rotary motion source means being connected with said driven shaft for providing rotary motion to said driven shaft.

6. Apparatus according to claim 4, wherein said apparatus further comprises a vertical sleeve being rotatably supported around said vertical shaft, said box-like body support means comprising a cylindrical body enveloping said second cup-like body and said first cup-like body, said cylindrical body defining a lower disk extending from an upper end of said vertical sleeve, said container conveyor support means comprising a support disk rigidly connected to a lower end of said vertical sleeve by means of a support disk sleeve, said container conveyor support means further comprising a plurality of support plates being arranged on said support disk for accommodating individual containers, said drive means comprising a support disk sleeve gearwheel rigidly associated with a lower end of said support disk sleeve, a driven gearwheel meshing with said support disk sleeve gearwheel, a driven shaft rigidly keyed with said driven gearwheel and downwardly traversing through said horizontal wall, and rotary motion source means being connected with said driven shaft for providing rotary motion to said driven shaft, said lower disk of said cylindrical body defining first through hole means for accommodating said first slidable shaft means and second through hole means for accommodating said second slidable shaft means, said apparatus further comprising hollow cylindrical body means being rigidly associated with said lower disk and upwardly extending therefrom above said second through hole means, said hollow cylindrical body means being thereby interposed between said first cup-like body and said second cup-like body and accommodating therein said second slidable shaft means, said first slidable shaft means being slidably interposed between a vertical wall of said cylindrical body and said second cup-like body, said first actuation cam means comprising a first cam groove being provided peripherally on said second cup-like body, first vertical slot means being provided in said vertical wall of said cylindrical body, said first roller means comprising a first pair of rollers being rigidly associated with said first slidable shaft means and slidably engaging with said first vertical slot means and said first cam groove, said second actuation cam means comprising a second cam groove being provided peripherally on said first cup-like body, second vertical slot means being provided in said hollow cylindrical body means, said second roller means comprising a second pair of rollers being rigidly associated with said second slidable shaft means and slidably engaging with said second vertical slot means and said second cam groove, said cylindrical body being upwardly provided with upper hole means for accommodating upper portions of said first slidable shaft means.

7. Apparatus according to claim 1, wherein said support structure means comprises a horizontal wall, a vertical shaft, a first cup-like body, and a second cup-like body, said vertical shaft being rigidly associated at a lower end thereof with said horizontal wall, said first cup-like body being rigidly associated with said vertical shaft at an upper end thereof and defining an upwardly directed cavity, said second cup-like body being rigidly associated with an upper region of said first cup-like body and defining a downwardly directed cavity enveloping said first cup-like body, said horizontal wall being rigidly associated with a support base means of said apparatus, said apparatus further comprising a vertical sleeve being rotatably supported around said vertical shaft, said box-like body support means comprising a cylindrical body enveloping said second cup-like body and said first cup-like body, said cylindrical body defining a lower disk extending from an upper end of said vertical sleeve, said container conveyor support means comprising a support disk rigidly connected to a lower end of said vertical sleeve by means of a support disk sleeve, said container conveyor support means further comprising a plurality of support plates being arranged on said support disk for accommodating individual containers, said drive means comprising a support disk sleeve gearwheel rigidly associated with a lower end of said support disk sleeve, a driven gearwheel meshing with said support disk sleeve gearwheel, a driven shaft rigidly keyed with said driven gearwheel and downwardly traversing through said horizontal wall, and rotary motion source means being connected with said driven shaft for providing rotary motion to said driven shaft.

8. Apparatus according to claim 7, wherein said lower disk of said cylindrical body defines first through hole means for accommodating said first slidable shaft means and second through hole means for accommodating said second slidable shaft means, said apparatus further comprising hollow cylindrical body means being rigidly associated with said lower disk and upwardly extending therefrom above said second through hole means, said hollow cylindrical body means being thereby interposed between said first cup-like body and said second cup-like body and accommodating therein said second slidable shaft means, said first slidable shaft means being slidably interposed between a vertical wall of said cylindrical body and said second cup-like body, said first actuation cam means comprising a first cam groove being provided peripherally on said second cup-like body, first vertical slot means being provided in said vertical wall of said cylindrical body, said first roller means comprising a first pair of rollers being rigidly associated with said first slidable shaft means and slidably engaging with said first vertical slot means and said first cam groove, said second actuation cam means comprising a second cam groove being provided peripherally on said first cup-like body, second vertical slot means being provided in said hollow cylindrical body means, said second roller means comprising a second pair of rollers being rigidly associated with said second slidable shaft means and slidably engaging with said second vertical slot means and said second cam groove, said cylindrical body being upwardly provided with upper hole means for accommodating upper portions of said first slidable shaft means, said third actuation cam means comprising a cylinder cam being rotatably supported about said vertical sleeve directly above said support disk sleeve, said cylinder cam being rigidly associated with said support base means by means of bracket means, said tube grip means comprising a cylindrical element defining a vertical axis coaxial with said second slidable shaft means and being rigidly associated with a lower end of said second slidable shaft means, said cylindrical element having a horizontal through hole being perpendicular to said vertical axis and slidably supporting therein a shaft having a first protruding end extending towards said cylinder cam and a second protruding end extending radially, with respect to said axis of rotation, from said cylindrical element, said cam follower actuation means comprising a roller ball accommodated within an adapted seat defined on said first protruding end of said shaft and a helical spring being wrapped about said first protruding end, said roller ball being in rolling contact with said cylinder cam, an abutment ring being provided at an extremity of said first protruding end of said shaft, said helical spring being interposed between said abutment ring and said cylindrical element, a horizontal plate being rigidly fixed to a lower base of said cylindrical element and extending therefrom radially with respect to said axis of rotation, said horizontal plate defining a free end being provided with a spread element comprising a vertical pin being rigidly connected and extending upwardly from said free end of said horizontal plate, said second protruding end of said shaft rotatably supporting, by means of two pivots, a pair of tube grip elements of a clamp element, each one of said pair of tube grip elements comprising an elongated horizontal plate being pivoted with one end thereof to one of said two pivots and defining at said one end a first semi-circular recess being directed toward an extension axis of said shaft and defining at another end thereof a second semi-circular recess being directed toward said extension axis of said shaft, a traction helical spring being mutually connected to middle portions of said each one of said pair of tube grip elements, a first circular opening being defined by each said first semi-circular recess and a second circular opening being defined by each said second semi-circular recess, said vertical pin spreading said clamp element and being capable of entering, subsequently to radial movements of said shaft, said first circular opening and said second circular opening, said second circular opening slidably grasping tubes of closures when said vertical pin is in said first circular opening.

9. Apparatus according to claim 1, wherein a container rotating conveyor transfer apparatus is provided for passing containers in succession to said container conveyor support means of said rotating conveyor closure unit means, said container rotating conveyor transfer apparatus being substantially circular and being peripherally provided with equally spaced containment recesses for holding therein containers to be passed to said container conveyor support means, a closure rotating conveyor transfer apparatus being furthermore provided for passing closures in succession to said closure grip means of said rotating conveyor closure unit means, a finished product rotating conveyor transfer apparatus being provided for receiving containers sealed with closures in succession from said rotating conveyor closure unit means and for passing containers sealed with closures in succession to a transfer line chain conveyor means.

* * * * *